US005883646A

United States Patent [19]

Beauchamp

[11] Patent Number: 5,883,646

[45] **Date of Patent: *Mar. 16, 1999**

[54] COMPACT FLEX-CIRCUIT FOR MODULAR ASSEMBLY OF OPTICAL SENSOR COMPONENTS IN AN INKJET PRINTER

[75] Inventor: Robert W. Beauchamp, Carlsbad, Calif.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 551,297

[22] Filed: Oct. 31, 1995

Related U.S. Application Data

[63] Continuation-in-part of Ser. No. 540,908, Oct. 11, 1995, Pat. No. 5,600,350, which is a continuation of Ser. No. 55,624, Apr. 30, 1993.

[51] Int. Cl.[6] ..... B41J 29/393

[52] U.S. Cl. ..... 347/19; 347/37

[58] Field of Search ..... 347/19, 37, 40, 347/43; 356/372, 402, 445, 448; 250/226, 208.2, 578.1

[56] References Cited

U.S. PATENT DOCUMENTS

| | | | |
|---|---|---|---|
| 4,471,384 | 9/1984 | Sato et al. | 358/282 |
| 5,170,047 | 12/1992 | Beauchamp et al. | 250/202 |
| 5,353,052 | 10/1994 | Suzuki et al. | 347/19 |
| 5,600,350 | 2/1997 | Cobbs et al. | 347/19 |

*Primary Examiner*—Safet Metjahic
*Assistant Examiner*—John Chizmar
*Attorney, Agent, or Firm*—David S. Romney

[57] ABSTRACT

A carriage-mounted optical sensor for a color inkjet printer/plotter includes a modular flex-circuit assembly which has a co-planar junction which directly interconnects with all electronic components such as through conductive support leads from a photocell and LEDs. Additional components are then self-attachable to the modular flex-circuit assembly to form an optical sensor unit having the LEDs positioned to transmit light to a print zone, and having the photocell positioned to receive reflected light from the print zone. A cover provides a protective shield for the electronics in the optical sensor, and is self-attachable in a predetermined position on the carriage. Separate activation circuits are provided for each LED to allow different LEDs to be selectively activated depending on the type of markings on the media.

30 Claims, 12 Drawing Sheets

COMPACT FLEX-CIRCUIT FOR MODULAR ASSEMBLY OF OPTICAL SENSOR COMPONENTS IN AN INKJET PRINTER

This application is a continuation-in-part of Ser. No. 08/540,908 filed on Oct. 11, 1995 (now U.S. Pat. No. 5,600,350), which is a continuation of Ser. No. 55,624 filed on Apr. 30, 1993 in the names of Keith E. Cobbs, Robert W. Beauchamp and Paul R. Sorenson.

RELATED APPLICATIONS

This application is related to the following commonly assigned co-pending applications which are incorporated herein by reference: Ser. No. 08/558,571 now issued as a U.S. patent entitled UNITARY LIGHT TUBE FOR MOUNTING OPTICAL SENSOR COMPONENTS ON AN INKJET PRINTER CARRIAGE filed Oct. 31, 1995 in the name of Robert W. Beauchamp; and Ser. No. 08/551,022 entitled OPTICAL PATH OPTIMIZATION FOR LIGHT TRANSMISSION AND REFLECTION IN A CARRIAGE-MOUNTED INKJET PRINTER SENSOR filed Oct. 31, 1995 in the names of Robert W. Beauchamp, Isidre Rosello and Josep Tarradas.

BACKGROUND OF THE INVENTION

This invention relates generally to inkjet printers/plotters, and more specifically to carriage-mounted optical sensors in an inkjet printer/plotter.

Many print quality benefits are achieved by mounting an optical sensor on a carriage which also carries printing elements, since the optical sensor can then pass over the media upon which the printing elements are applying alphanumeric indicia, graphics or images. For example, see commonly assigned U.S. Pat. No. 5,170,047 entitled OPTICAL SENSOR FOR PLOTTER PEN VERIFICATION, and U.S. Pat. No. 5,448,269 entitled MULTIPLE INKJET CARTRIDGE ALIGNMENT FOR BIDIRECTIONAL PRINTING BY SCANNING A REFERENCE PATTERN, both of which are incorporated herein by reference.

The full color inkjet printer/plotters which have been developed comprise a plurality of inkjet pens of diverse colors. A typical color inkjet printer/plotter has four inkjet pens, one that stores black ink, and three that store colored inks, e.g., magenta, cyan and yellow. The colors from the three color pens are mixed to obtain any particular color.

The pens are typically mounted in stalls within an assembly which is mounted on the carriage of the printer/plotter. The carriage assembly positions the inkjet pens and typically holds the circuitry required for interface to the heater circuits in the inkjet pens.

Full color printing and plotting requires that the colors from the individual pens be precisely applies to the media. This requires precise alignment of the carriage assembly. Unfortunately, mechanical misalignment of the pens in conventional inkjet printer/plotters results in offsets in the X direction (in the media or paper axis) and in the Y direction (in the scan or carriage axis). This misalignment of the carriage assembly manifests as a misregistration of the print images applied by the individual pens. In addition, other misalignments may arise due to the speed of the carriage, the curvature of the platen and/or spray from the nozzles.

However, the integration of the optical and electronic components in the optical sensor, as well as positioning the optical sensor on the carriage have been complicated, expensive and to some extent imprecise in prior printers/plotters.

The need for reliability and precision is even greater in recent inkjet printers/plotters which print high resolution color graphics and images, often on very large poster-size printouts.

Also, it is desirable to simplify the circuitry on the optical sensor in order to facilitate easy inexpensive production and assembly without the need for an excessive number of parts.

BRIEF SUMMARY OF THE INVENTION

Accordingly, it is a general object of the invention to provide a modular structure which integrates the optical and electronic components in a simplified but reliable way on an optical sensor unit.

More specifically, the invention contemplates a carriage-mounted optical sensor for an inkjet printer/plotter which includes a modular flex-circuit assembly which has a co-planar junction on a first end and a circuit-board interconnect on the other end. The co-planar junction directly interconnects electrically with all of the electronic components on the optical sensor unit and also provides structural support through wire leads from a photocell and LEDs. Additional optical and positioning components are then self-attachable to the modular flex-circuit assembly to form an optical sensor unit having the LEDs positioned to transmit light to a print zone, and having the photocell positioned to receive reflected light from the print zone. A protective casing surrounds and supports the electronic and optical components in the sensor unit and also is self-attachable and pre-positioned through X/Y/Z axis datums to the carriage. Separate activation circuits are provided for each LED to allow different LEDs such as LEDs emitting different colored light to be selectively activated depending on the type of markings on the media.

DETAILED DESCRIPTION OF PREFERRED EMBODIMENT

Figure 1:
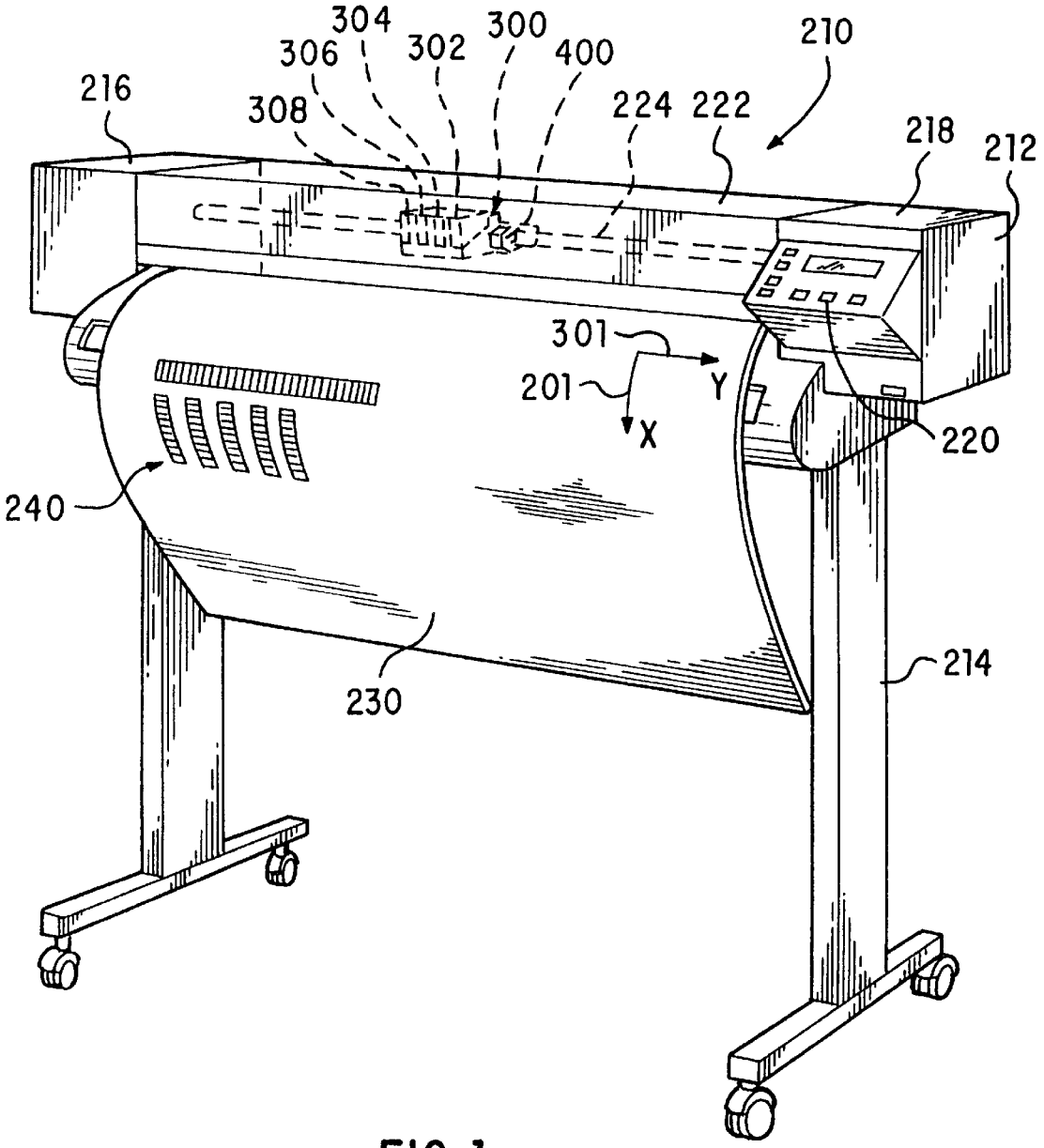
FIG. 1 is a perspective view of a large format inkjet printer/plotter incorporating the features of the present invention.

FIG. 1 is a perspective view of an inkjet large format printer/plotter incorporating the teachings of the present invention. The printer 210 includes a housing 212 mounted on a stand 214. The housing has left and right drive mechanism enclosures 216 and 218. A control panel 220 is mounted on the right enclosure 218. A carriage assembly 300, illustrated in phantom under a cover 222, is adapted for reciprocal motion along a carriage bar 224, also shown in phantom. The position of the carriage assembly 300 in a horizontal or carriage scan axis is determined by a carriage positioning mechanism 310 with respect to an encoder strip 320 (see FIG. 2). A print medium 330 such as paper is positioned along a vertical or media axis by a media axis drive mechanism (not shown). As used herein, the media axis is called the X axis denoted as 201, and the scan axis is called the Y axis denoted as 301.

Figure 2:
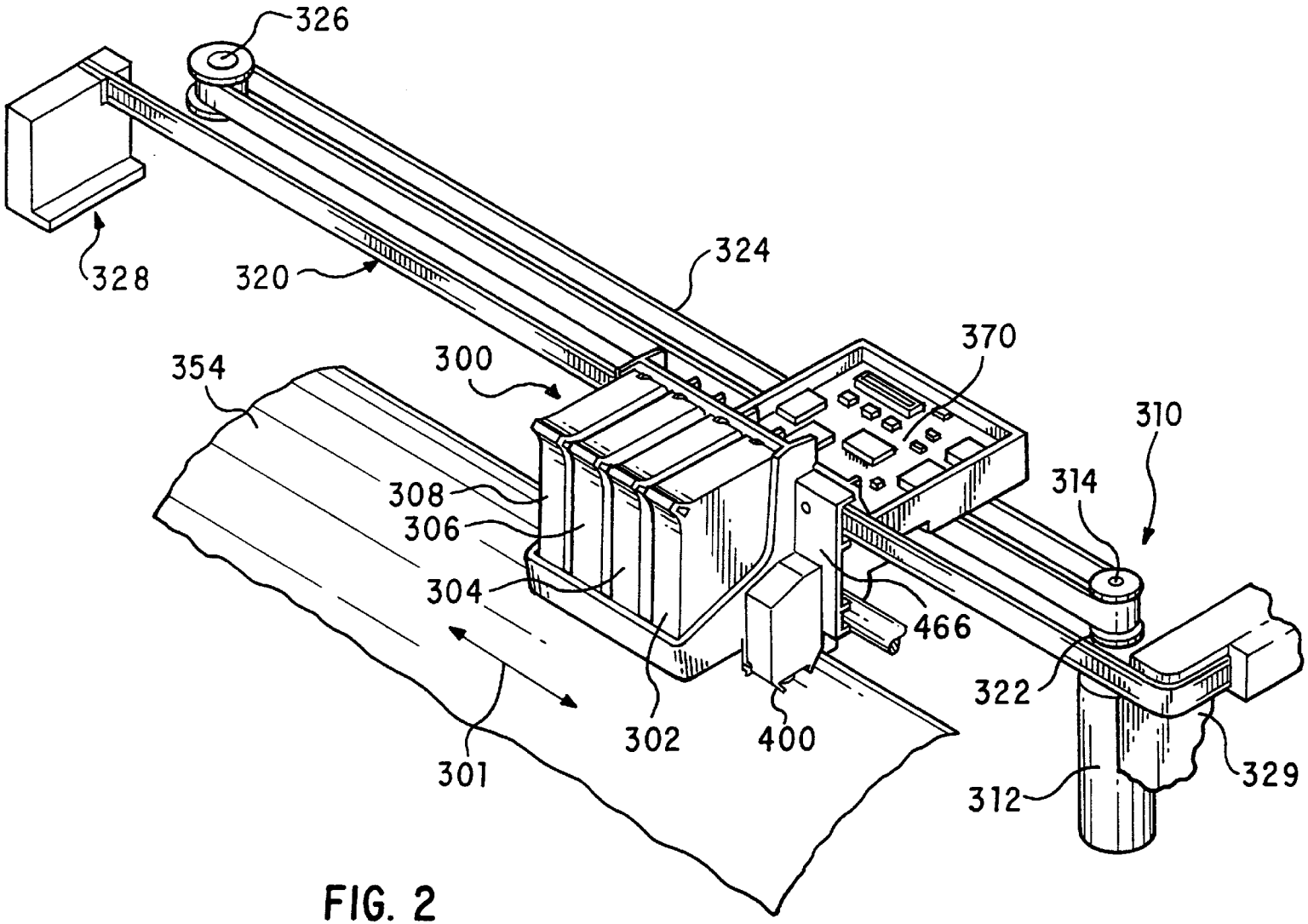
FIG. 2 is close-up view of the carriage portion of the printer/plotter of FIG. 1 showing a carriage-mounted optical sensor of the present invention.

FIG. 2 is a perspective view of the carriage assembly 300, the carriage positioning mechanism 310 and the encoder strip 320. The carriage positioning mechanism 310 includes a carriage position motor 312 which has a shaft 314 which drives a belt 324 which is secured by idler 326 and which is attached to the carriage 300.

The position of the carriage assembly in the scan axis is determined precisely by the encoder strip 320. The encoder strip 320 is secured by a first stanchion 328 on one end and a second stanchion 329 on the other end. An optical reader (not shown) is disposed on the carriage assembly and provides carriage position signals which are utilized by the invention to achieve optimal image registration in the manner described below.

Figure 3:
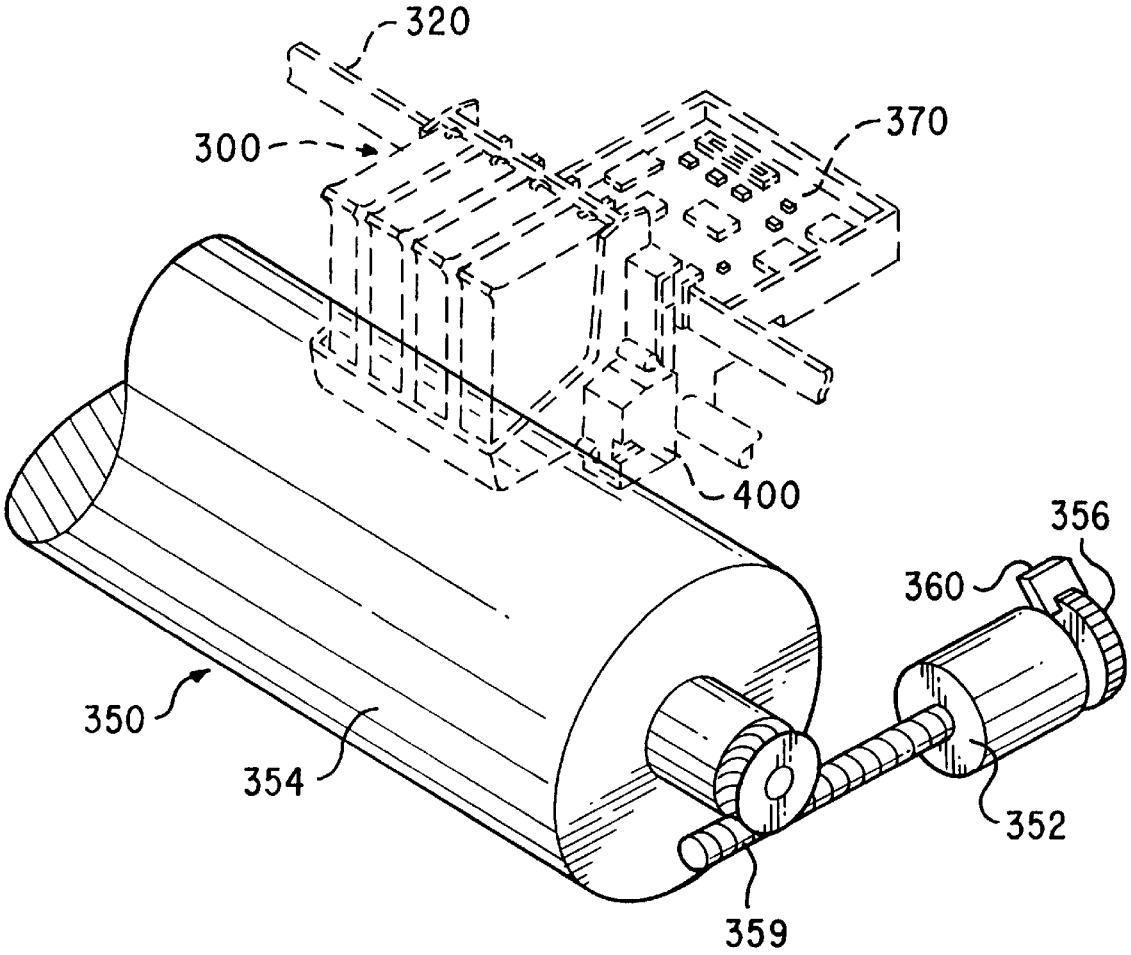
FIG. 3 is a close-up view of the platen portion of the printer/plotter of FIG. 1 showing the carriage portion in phantom lines.

FIG. 3 is perspective view of a simplified representation of a media positioning system 350 which can be utilized in the inventive printer. The media positioning system 350 includes a motor 352 which is normal to and drives a media roller 354. The position of the media roller 354 is determined by a media position encoder 356 on the motor. An optical reader 360 senses the position of the encoder 356 and provides a plurality of output pulses which indirectly determines the position of the roller 354 and, therefore, the position of the media 230 in the X axis.

The media and carriage position information is provided to a processor on a circuit board 370 disposed on the carriage assembly 100 for use in connection with printhead alignment techniques of the present invention.

The printer 210 has four inkjet print cartridges 302, 304, 306, and 308 that store ink of different colors, e.g., black, magenta, cyan and yellow ink, respectively. As the carriage assembly 300 translates relative to the medium 230 along the X and Y axes, selected nozzles in the inkjet print cartridges 302, 304, 306, and 308 are activated and ink is applies to the medium 230. The colors from the three color cartridges are mixed to obtain any other particular color. Sample lines 240 are typically printed on the media 230 prior to doing an actual printout in order to allow the optical sensor 400 to pass over and scan across the lines as part of the initial calibration.

The carriage assembly 300 positions the inkjet print cartridges and holds the circuitry required for interface to the ink firing circuits in the print cartridges. The carriage assembly 300 includes a carriage 301 adapted for reciprocal motion on front and rear slider rods 303, 305.

As mentioned above, full color printing and plotting requires that the colors from the individual print cartridges precisely applied to the media. This requires precise alignment of the carriage assembly as well as precise alignment of the print cartridges in the carriage. Unfortunately, paper slippage, paper skew, and mechanical misalignment of the print cartridges results in offsets in the X direction (in the media advance axis) and in the Y direction (in the carriage or axis) as well as angular theta offsets. This misalignment causes misregistration of the print images/graphics formed by the individual ink drops on the media. This is generally unacceptable as multi-color printing requires image registration accuracy from each of the printheads to within 1/1000 inch (1 mil).

Figure 4:
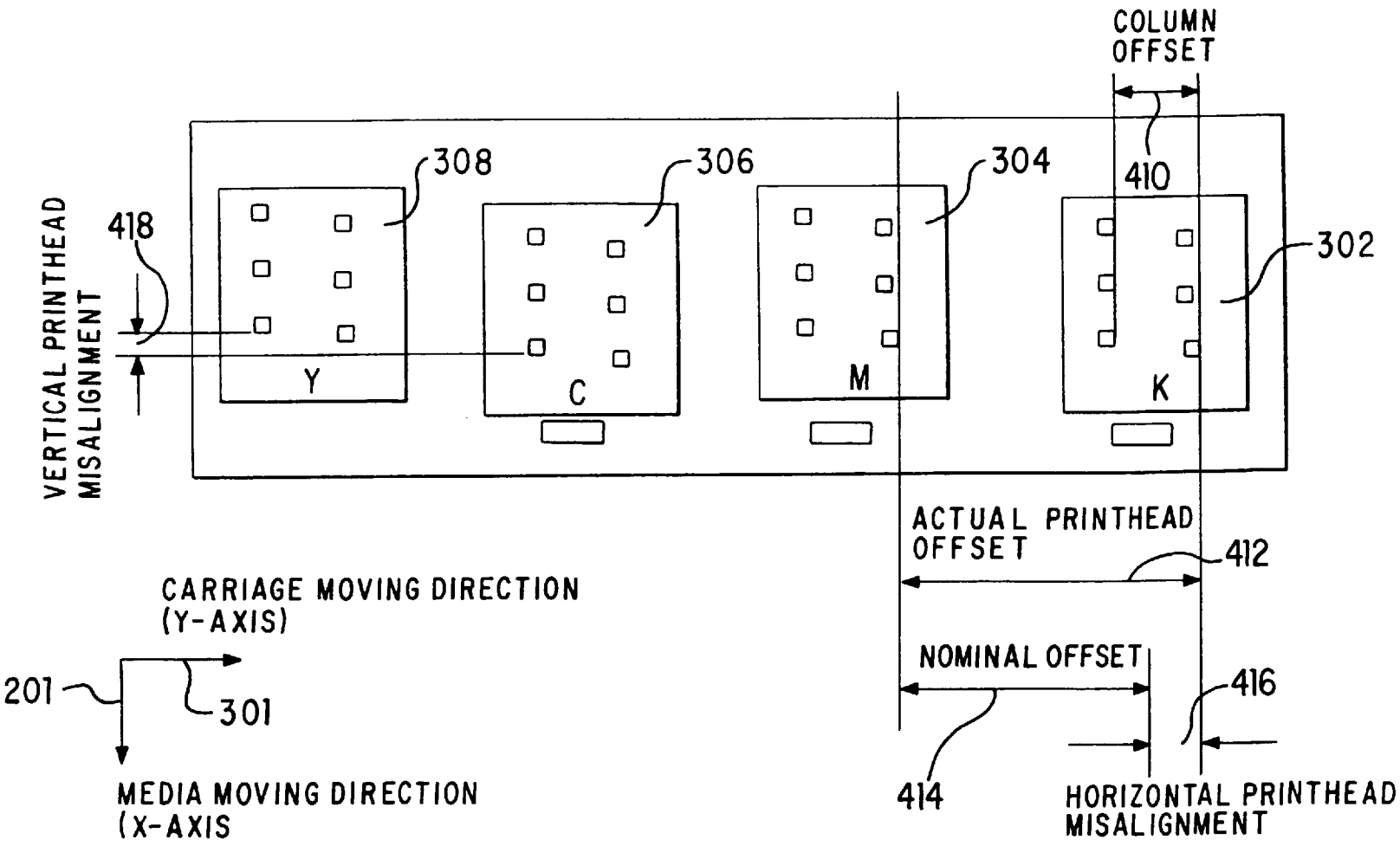
FIG. 4 is a schematic representation of a top view of the carriage showing offsets between individual printheads in the media advance axis and in the carriage scan axis.

FIG. 4 shows a presently preferred embodiment of printheads each having two groups of nozzles with a column offset 410. By comparing the relative positions of corresponding nozzles in different printheads along the Y axis, it is possible to determinine an actual horizontal offset 412 between two printheads, and by comparison with a nominal default offset 414 determine an actual offset 416 in the carriage scan axis. This is repeated for all of the different printheads while they remain on the carriage.

Similarly, by comparing the relative positions of corresponding nozzles in different printheads along the X axis, it is possible to determine an actual vertical offset 418 in the media advance axis. This is also repeated for all of the different printheads while they remain on the carriage.

Figure 5A:
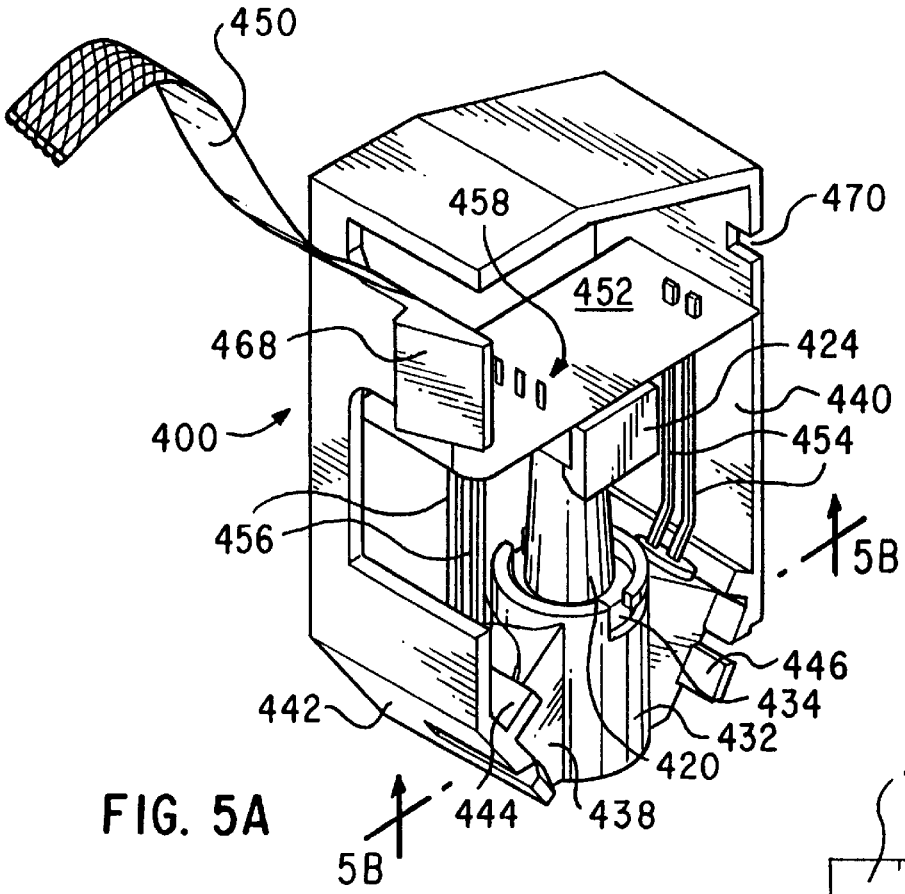
FIG. 5A is an isometric view showing a fully assembled optical sensor unit incorporating a presently preferred embodiment of the invention.
Figure 5B:
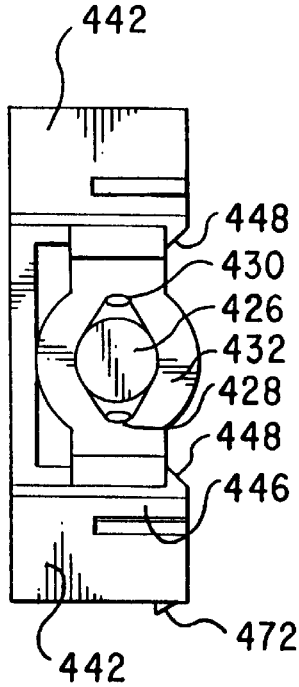
FIG. 5B is a bottom view of the optical sensor unit taken along the line 5B—5B in FIG. 5A.
Figure 6:
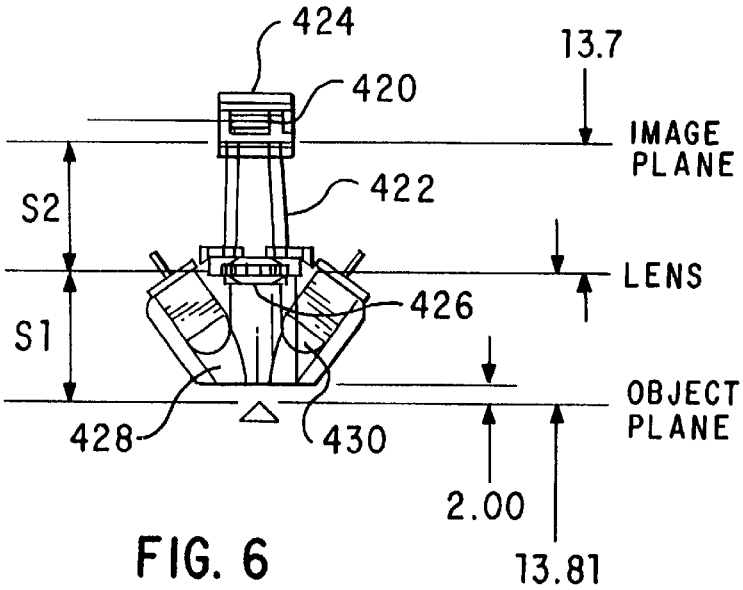
FIG. 6 is a front view of the optical components of the sensor unit of FIG. 5A.

In order to accurately scan across a test pattern line, the optical sensor 400 is designed for precise positioning of all of its optical components. Referring to FIGS. 5A, 5B, and 6, the sensor unit includes a photocell 420, holder 422, cover 424, lens 426, and light source such as two LEDs 428, 430. A unitary light tube or cap 432 has a pair of notched slots 434 which engage matching tabs 436 on a lower end of the holder 422 upon insertion and relative rotation between the cap and the holder. The two LEDs are held in opposite apertures of two shoulders 438 which have a size slightly less than the outside diameter of the LEDs, to prevent the LEDs from protruding into a central passageway which passes through the holder to the photocell.

A protective casing 440 which also acts as an ESD shield for the sensor components is provided for attachment to the carriage as well as for direct engagement with the shoulders of the light tube. In that regard, the top of the shoulders are sized and shaped to snugly fit inside downwardly tapered side walls 442 of the casing, with the top of the LEDs abutting against an upstanding flange 444 and with a lower portion of the shoulders held tightly by arms 446 which flex outwardly to an open position while the light tube is being pushed into a position of engagement with the casing. Upon completion of the engagement, the arms return to a closed latched position with a lip 448 on the end of each arm 446 preventing disengagement of the light tube (and its LEDs) during normal use.

Figures 7A, 7B:
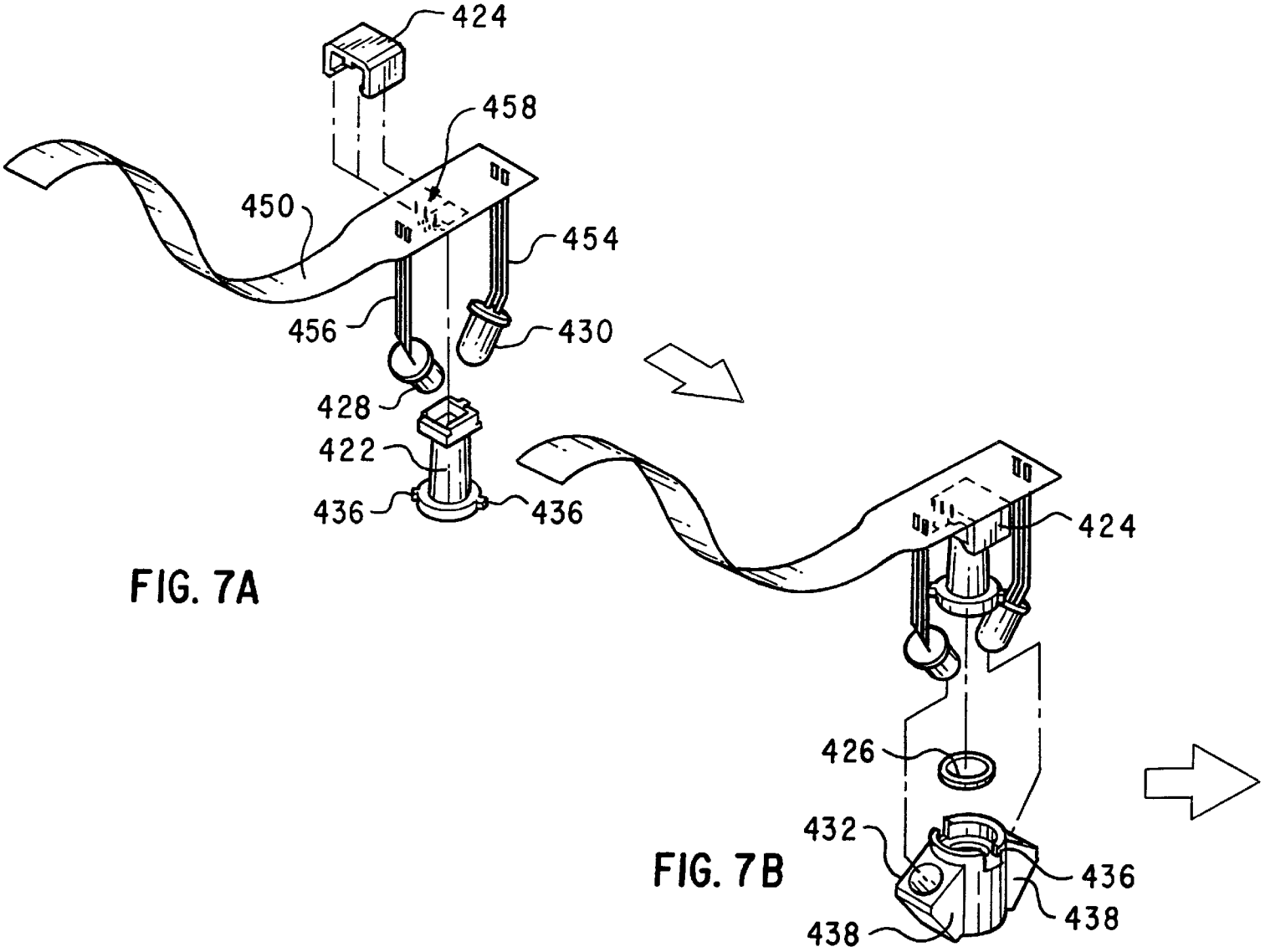
FIGS. 7A, 7B, 7C, 7D and 7E are a sequential representation showing a presently preferred set of modular assembly steps for the optical sensor unit.
Figures 7C, 7D, 7E:
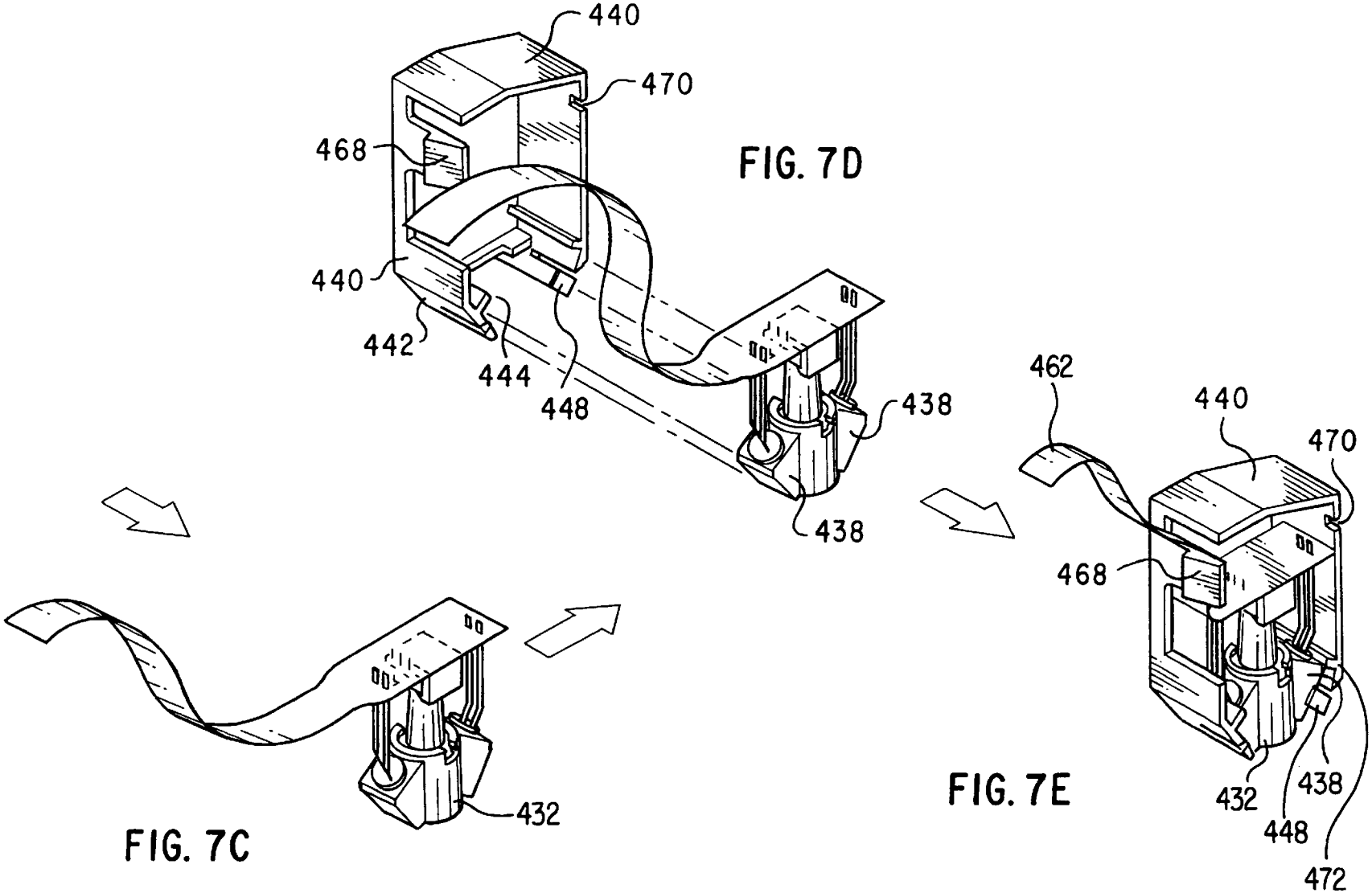

FIGS. 7A–7E show a preferred sequence of steps for assembling the optical sensor. Firstly, a modular flex-circuit assembly is created with an elongated TAB circuit 450 having a junction portion 452 with soldered through-holes which (a) connect and support a first pair of wire leads 454 to one LED, (b) connect and support a second pair of wire leads 456 to another LED, and (c) connect and support a set of three wire leads 458 coming from the photocell (FIG. 7A). Secondly a U-shaped cover 424 holds the photocell in nested position at the upper end of the holder, while the LEDs and holder are positioned by the light tube (FIGS. 7B–7C). Finally, the subassembly is inserted into the casing, with a free end 462 of the TAB circuit extending out through an access slot in the casing (FIGS. 7D and 7E).

It will be appreciated by those skilled in the art from the foregoing description that the invention provides a self-fixturing modular assembly whereby the light tube acts as a cap for holding both the two LEDs as well as the lens/holder/photocell/cover composite in fixed relative positions. Accordingly, if desirable the soldering of the interconnections at the co-planar junction portion of the flex-circuit can be done after assembly of the various component parts held by the cap.

Figure 9:
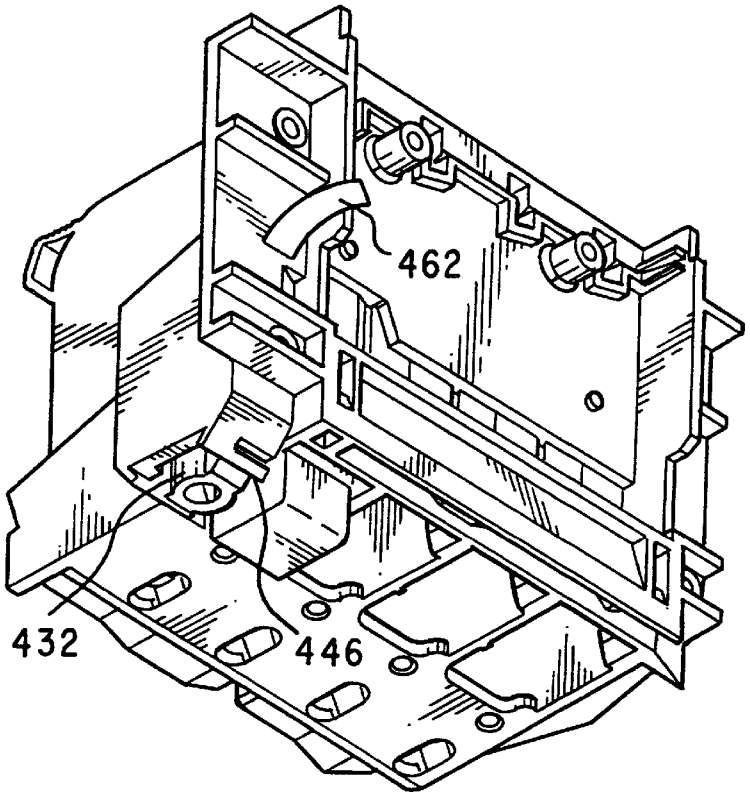
FIG. 9 is an isometric view looking up from the right rear side of the carriage showing the optical sensor and one print cartridge mounted on the carriage.
Figure 8:
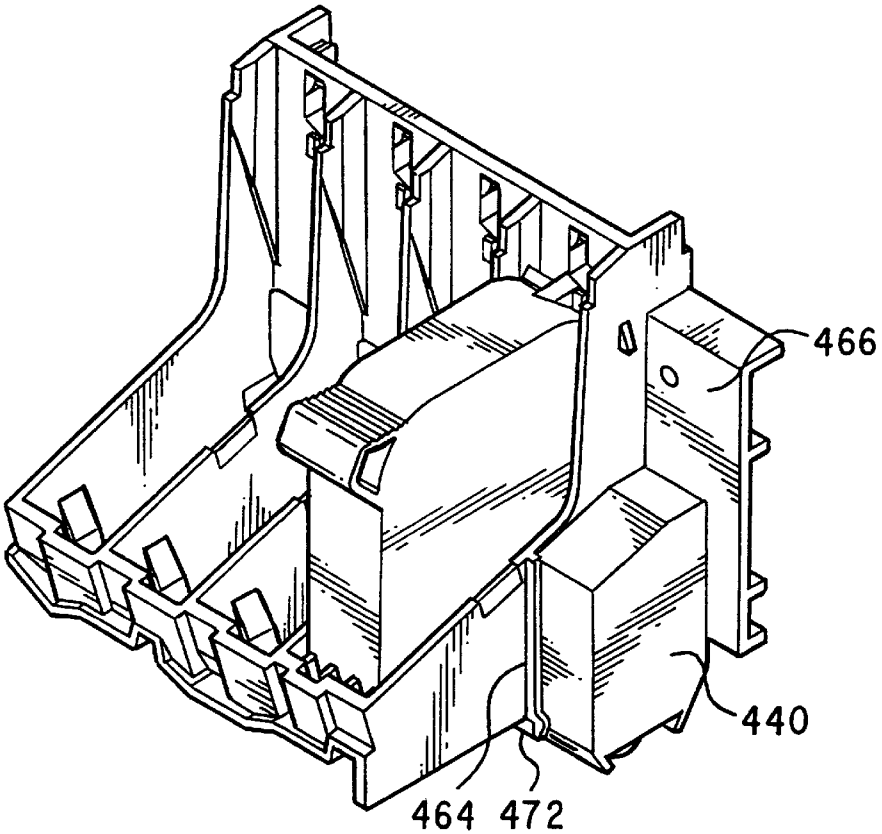
FIG. 8 is an isometric view looking down from the right front side of the carriage showing the optical sensor and one print cartridge mounted on the carriage.
Figure 10:
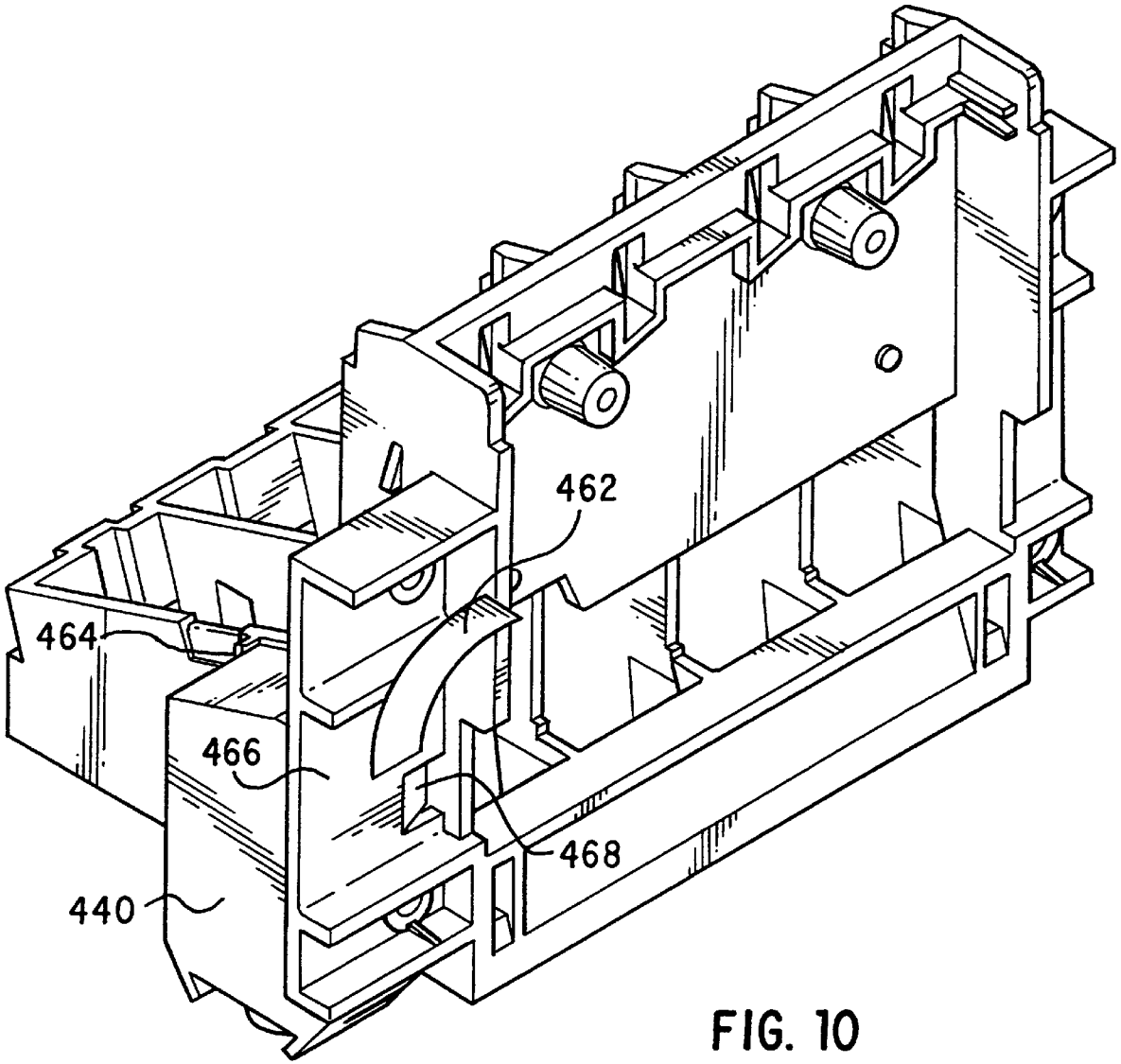
FIG. 10 is an isometric view looking down from the right rear side of the carriage showing the optical sensor mounted on the carriage.

The fully assembled optical sensor unit can then be placed inside of vertical rib 464 and against back plate 466 for self-attachment by rear tab 468, front notch 470, and lower front hook 472 to matching X/Y/Z datum-like surfaces on the carriage (see FIGS. 8–10).

It will be understood by those skilled in the art that by having the electronic components of the optical sensor all connected through a common co-planar junction portion of a flex-circuit allows the flex-circuit to be small and less costly. Also, it allows for the substitution of an even less expensive printed circuit board at the common junction if necessary.

Figure 12:
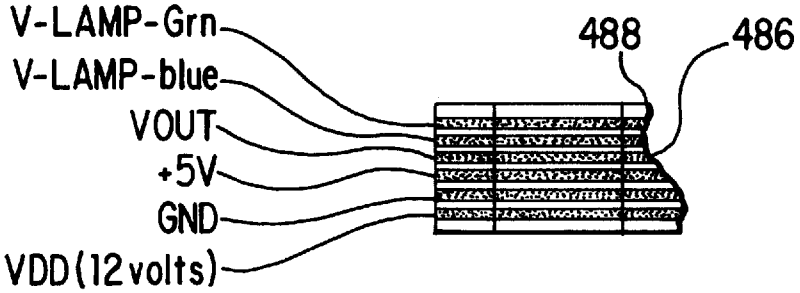
FIG. 12 is a top view identifying an exemplary circuit arrangement at a second end of the flex circuit.
Figure 11:
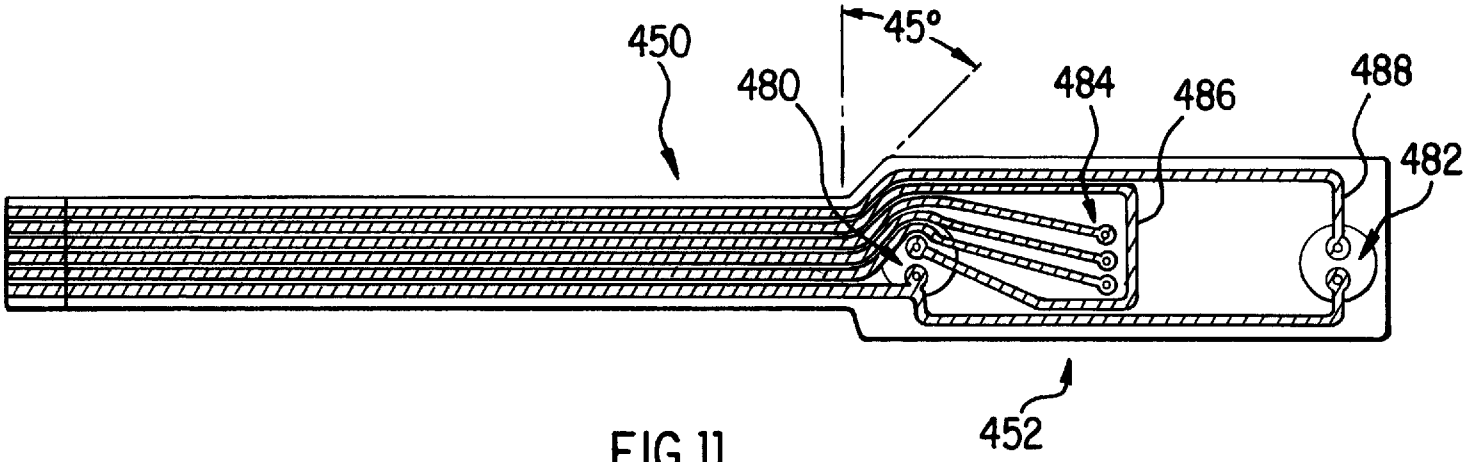
FIG. 11 is a top view of the entire flex-circuit showing the details of the co-planar junction portion at a first end of the flex-circuit.
Figure 13:
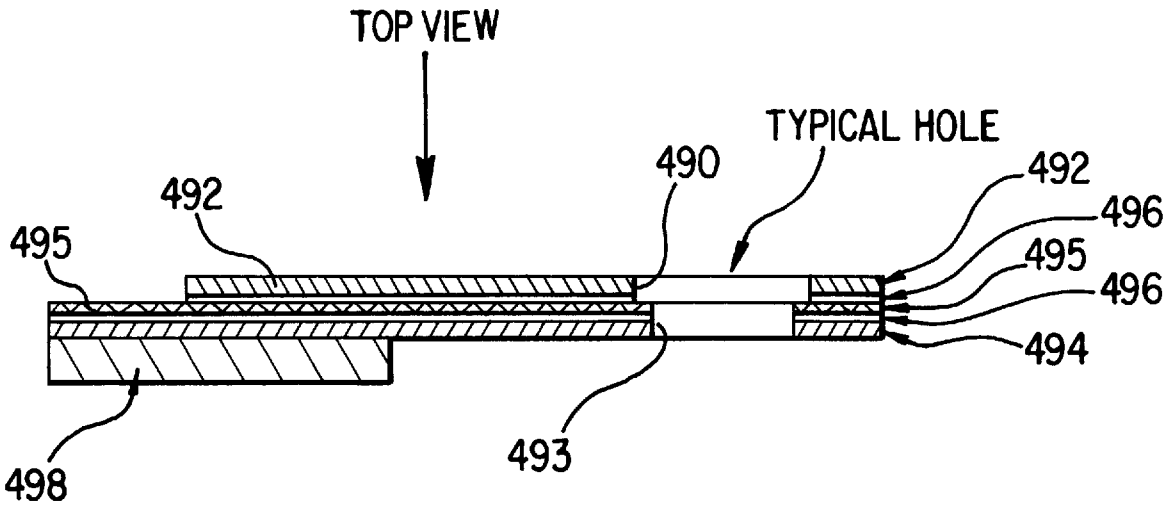
FIG. 13 is an enlarged sectional view showing an exemplary through-hole for the co-planar junction portion.

The specification details of the flex-circuit member and its co-planar junction are shown in FIGS. 11–13, and are self explanatory. It is noted that the co-planar junction 452 is wider than the rest of the TAB circuit to allow sufficient space for a pair of solder connections 480 for a blue light LED, a pair of solder connections 482 for a green light LED, and a set of three solder connections 484 for the photocell. A first activation line 486 connects the blue light LED and a second separate activation line 488 connects the green light LED to allow independent control over the LEDs depending on the media markings. It is noted that in this particular embodiment, the green light LED is used to sense media markings made by black, or cyan, or magenta ink, while the blue light LED is used to sense media markings made by yellow ink.

The details of the through-holes in the junction portion are shown in FIG. 13, with an enlarged diameter upper hole 490 through a polyimide coverlay 492 and an smaller diameter lower hole 493 through a polyimide base 494 and a copper conductor layer 495. Acrylic adhesive layers 496 provide the required lamination for the TAB circuit. A small bottom stiffener layer 498 provides support for exposed ends of the conductors to be connected to a carriage circuit board such as through a zif connector.

Figure 14:
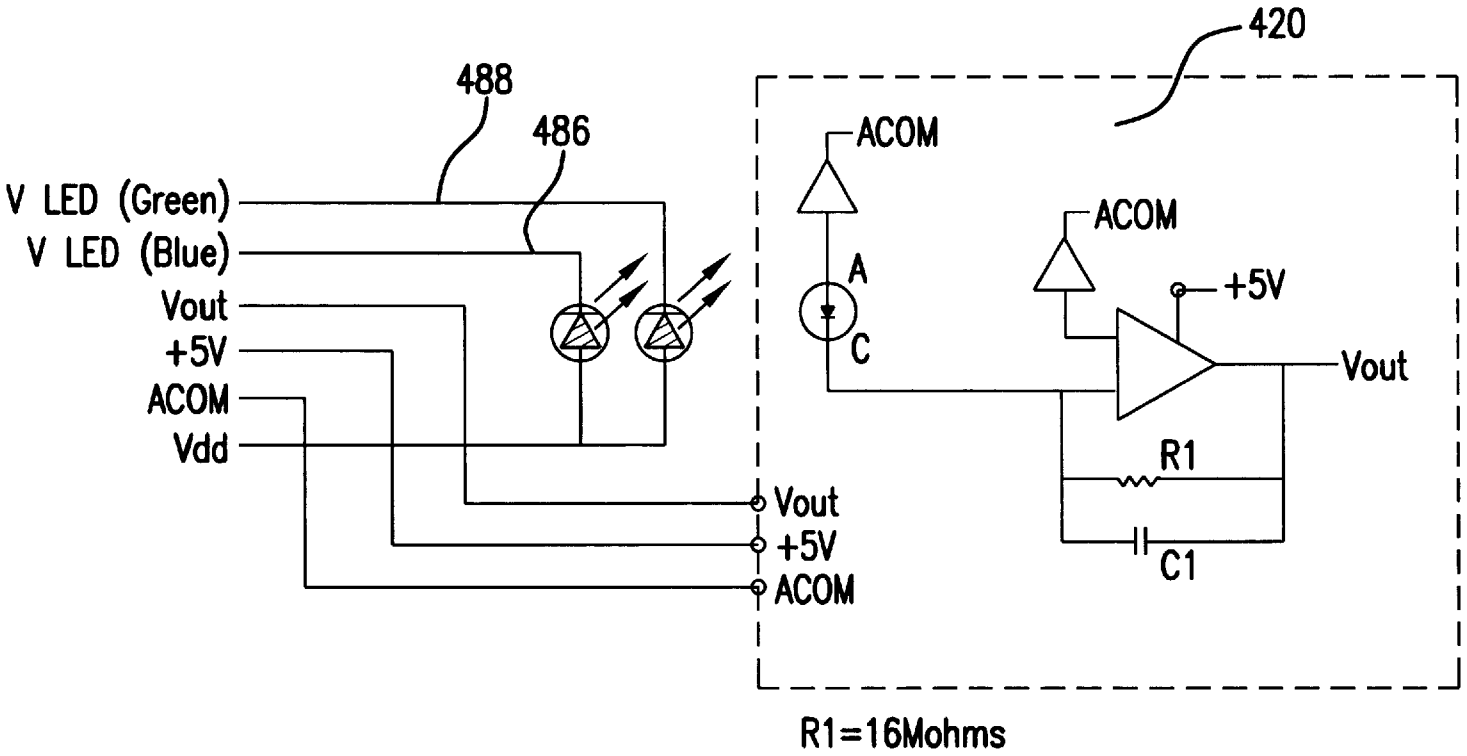
FIG. 14 is a schematic representation showing the interconnection between the circuitry interconnections between the flex-circuit and the photocell.

The circuitry for both the photocell 420 (with amplifier) as well as for the green light and blue light LEDs is shown schematically in FIG. 14.

The benefits and details of the optical features of the unitary light tube are more fully described in the previously identified co-pending application entitled OPTICAL PATH OPTIMIZATION FOR LIGHT TRANSMISSION AND REFLECTIONIN A CARRIAGE-MOUNTED INKJET PRINTER SENSOR.

It should be understood that various changes and modifications can be made to the illustrated embodiments of the invention described herein, all without departing from the spirit and scope of the invention as set forth in the following claims.

I claim as my invention:

1. A printer/plotter with one or more inkjet printheads for applying ink to media in a print zone, comprising:

a carriage for holding said printheads in a stationary position a predetermined distance over said print zone while said carriage moves in a carriage scan direction across said media;

an optical sensor unit mountable on said carriage;

at least one light source on said optical sensor unit for transmitting light to said print zone;

a photocell on said optical sensor unit for receiving light reflected from said print zone; and a modular circuit assembly having a single co-planar end junction portion to electrically interconnect and support said light source, and to electrically interconnect and support said photocell; and a protective casing for holding said optical sensor unit, said casing mounting said optical sensor unit in a fixed position on said carriage.

2. The printer/plotter of claim 1 wherein said light source includes an LED.

3. The printer/plotter of claim 1 wherein said light source includes at least two light sources each emitting a different color of light for use in alignment calibration of inkjet printheads.

4. The printer/plotter of claim 1 wherein said modular circuit assembly includes a flex-circuit with said co-planar junction portion located at one end of said flex-circuit.

5. The printer/plotter of claim 1 which further includes a plurality of inkjet printheads each having a different color of ink.

6. The printer/plotter of claim 5 wherein said plurality of inkjet printheads includes color inks taken from the group of cyan, yellow, magenta, black, red, green and blue.

7. The printhead/plotter of claim 1 wherein said casing is self-attachable to said carriage through X/Y/Z position datums.

8. The printhead/plotter of claim 1 wherein said modular circuit assembly includes a flex-circuit co-planar junction portion having through-holes for interconnection with supportive conductive wires from said light source and from said photocell, respectively.

9. The printhead/plotter of claim 8 wherein all of the electronic elements of said optical sensor unit are connected to said modular circuit assembly through said co-planar junction portion.

10. The printhead/plotter of claim 9 wherein all of said electronic elements of said optical sensor are supported from one side of said flex-circuit co-planar junction portion.

11. A method for modular assembly of optical sensor components for an inkjet printer/plotter, comprising:

making a first modular component by attaching at least one light source and a photocell to one co-planar junction portion of a flex-circuit;

creating a second composite modular component formed by combining the first modular component with a plurality of structural elements for positioning the light source and the photocell relative to each other;

providing a third modular component constituting a protective casing; and attaching the casing to the second composite modular component to form an optical sensor unit.

12. The method of claim 11 wherein said creating step includes combining the first modular component with a light tube which is optically aligned with the light source.

13. The method of claim 11 wherein said providing step includes providing a casing having X/Y/Z axis positioning datums, and wherein said attaching step includes placing the X/Y/Z axis positioning datums in engagement with matching datums on the printer carriage.

14. The method of claim 11 wherein said making step includes providing an electrical connection through a common junction portion between the flex-circuit on the one hand and the light source and photocell on the other hand.

15. The method of claim 11 wherein said making step includes providing a support through a common junction portion between the flex-circuit on the one hand and the light source and photocell on the other hand.

16. The method of claim 11 wherein said making step includes providing an electrical and supportive connection between a common junction portion at one end of the flex-circuit on the one hand and the light source and photocell on the other hand.

17. The method of claim 11 which further includes mounting the optical sensor unit formed by said attaching step to a printer carriage.

18. An optical sensor unit for an inkjet printer carriage, comprising:

a first modular component having a flex-circuit directly attached at a common co-planar junction portion through wire leads to at least one light source and a photocell;

a plurality of structural elements for positioning the light source and the photocell relative to each other; and a second modular component having a casing for said light source and said photocell.

19. The optical sensor unit of claim 18 which further includes first terminal means at one end of said flex-circuit for providing a junction with all circuit elements of said optical sensor, and second terminal means an an opposite end of said flex-circuit for providing an electrical connection with a circuit board on the inkjet printer carriage.

20. The optical sensor unit of claim 18 wherein said casing includes first self-attachment means integral with said casing for positioning said light source and said photocell.

21. The optical sensor unit of claim 18 wherein said casing includes second self-attachment means integral with said casing for mounting the optical sensor unit in a predetermined position on the inkjet printer carriage.

22. The optical sensor unit of claim 21 which further includes a plurality of printheads mounted on the carriage for applying ink to a print zone as the carriage moves along a scan axis.

23. The optical sensor unit of claim 22 wherein said casing is mounted in a predetermined position on the inkjet printer carriage to enable light transmitted from the light source to said print zone to be reflected back toward said photocell.

24. The optical sensor unit of claim 18 wherein said second modular component includes ESD shielding surrounding the active electronic components of said optical sensor unit.

25. The optical sensor unit made by the steps of claim 11.

26. A printer/plotter with a plurality of inkjet printheads for applying different color inks to media in a print zone, comprising:

a carriage for holding said printheads in a stationary position a predetermined distance over said print zone while said carriage moves in a carriage scan direction across said media;

an optical sensor unit mountable on said carriage;

at least two light sources on said optical sensor unit for transmitting light to the media, each light source emitting light of a different color for use in alignment calibration;

a photocell on said optical sensor unit for receiving light reflected from the media;

a circuit assembly having a junction portion to electrically interconnect and support said light sources, and to electrically interconnect and support said photocell; and a separate actuation circuit for each of said at least two light sources to selectively activate them based on the type of markings on the media.

27. The printer/plotter of claim 26 wherein said light sources include LEDs.

28. The printer/plotter of claim 27 wherein said light sources include at least one LED emitting green light and at least one LED emitting non-green light.

29. The printer/plotter of claim 28 wherein said light sources include at least one LED emitting blue light.

30. The printer/plotter of claim 26 wherein said separate actuation circuits selectively activate said at least two light sources only one-at-a-time.

* * * * *